United States Patent [19]

Bernard et al.

[11] Patent Number: 4,572,541

[45] Date of Patent: Feb. 25, 1986

[54] SAFETY TOE-ABUTMENT MEMBER FOR A SKI

[75] Inventors: Jean Bernard; Jean Beyl, both of Nevers; Daniel le Faou, Varennnes Vauzelles; Henri Peyre; Patrice Viodet, both of Nevers, all of France

[73] Assignee: Ste LOOK, Nevers, France

[21] Appl. No.: 518,938

[22] Filed: Aug. 1, 1983

[30] Foreign Application Priority Data

Aug. 3, 1982 [FR] France ..... 82 13510

[51] Int. Cl.[4] ..... A63C 9/08

[52] U.S. Cl. ..... 280/628; 280/630; 280/632

[58] Field of Search ..... 280/628, 629, 630, 631, 280/632, 634, 625, 627

[56] References Cited

U.S. PATENT DOCUMENTS 3,612,559 10/1971 Petersen ..... 280/628
4,218,071 8/1980 Salomon ..... 280/630
4,358,132 11/1982 Beyl ..... 280/628

FOREIGN PATENT DOCUMENTS 2356908 5/1975 Fed. Rep. of Germany .
2637811 3/1978 Fed. Rep. of Germany .
2395046 1/1979 France .
2413915 8/1979 France .
2418656 9/1979 France .

*Primary Examiner*—Joseph F. Peters, Jr.
*Assistant Examiner*—Joseph G. McCarthy
*Attorney, Agent, or Firm*—Young & Thompson

[57] ABSTRACT

A toe-abutment member providing safety ski boot release in the event of a backward-fall movement combined with a twisting movement of the skier's leg comprises a fixed locking member having an inclined ramp and an abutment body pivotally mounted on a cross-pin. The jaw unit for retaining the toe end of the ski boot is movably mounted within the abutment body and carries a transverse rod which is applied against the ramp by means of a spring-loaded piston.

10 Claims, 12 Drawing Figures

Fig. 10
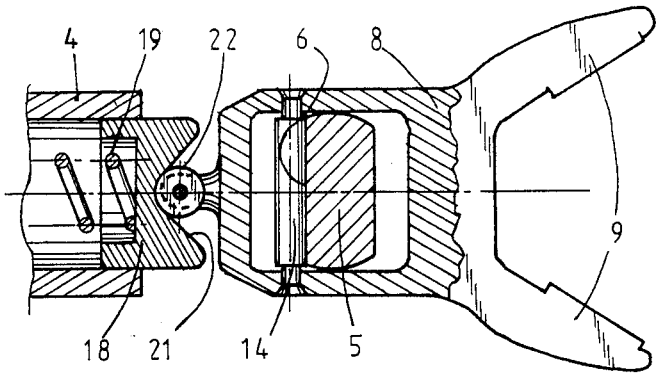
Fig. 11
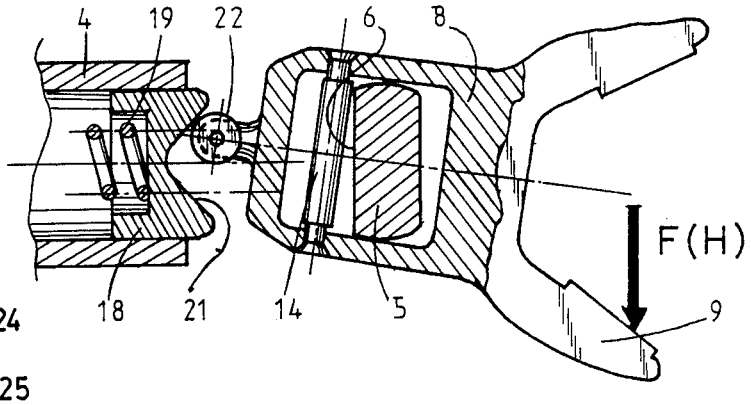
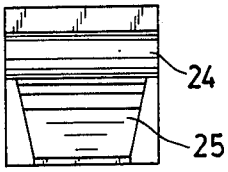
Fig. 13
Fig. 12
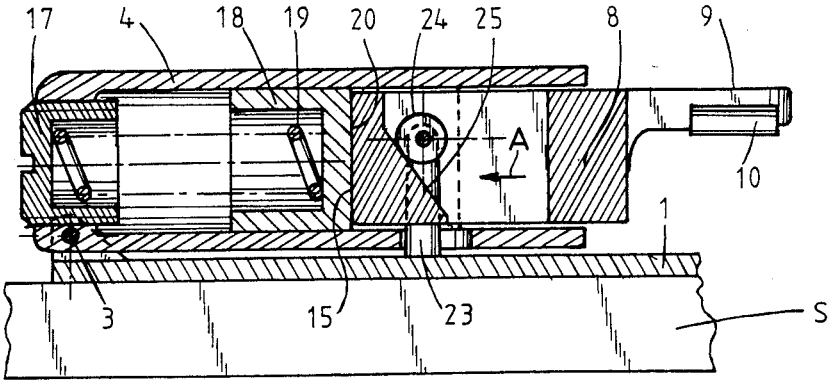

SAFETY TOE-ABUTMENT MEMBER FOR A SKI

This invention relates to a safety toe abutment member for skis.

Modern safety ski bindings are usually made up of two elements for retaining the boot on the ski: the toe abutment member which is adapted to cooperate with the toe end of the ski boot and the heel-holding member which is adapted to cooperate with the heel end of the ski boot.

The toe abutment member permits lateral disengagement of the ski boot when an excessive torsional stress is exerted on the skier's leg. The heel-holding member permits vertical release of the skier's heel when the leg is subjected to an excessive forward bending stress.

As disclosed, for example, in U.S. Pat. No. DE. 2,637,871, another known type of toe abutment member permits vertical release of the toe end of the ski boot when the skier is subjected to a backward fall.

Moreover, toe abutment members have been proposed in which the jaw unit for retaining the toe end of the ski boot is not only capable of pivotal displacement for releasing the ski boot in the lateral direction but is also capable of forward displacement in the event of a longitudinal thrust exerted by the ski boot. Thus, in the toe abutment member described in the Patent Appln. No. FR. 2,395,046, the jaw unit is slidably mounted on the body of the toe abutment member. The system for rotational locking of the abutment body on its pivot-pin comprises a piston resiliently applied against a flat surface formed on the pivot-pin. When subjected to a high degree of axial thrust, the jaw unit moves forward and thrusts back the piston which is thus moved away from the flat surface, whereupon the abutment body is capable of rotating freely on its pivot-pin. By virtue of this arrangement, the parasitic friction forces generated by the axial thrust between the ski boot and the toe abutment member are compensated automatically, the stiffness of opening of the toe abutment member being maintained at a practically constant level.

The invention has for its object a toe abutment member which permits both a backward-fall release and compensation for parasitic friction forces arising from an axial thrust while at the same time providing the advantages of relatively simple and lightweight construction, of low cost price and of reliable operation.

To this end, the toe abutment member in accordance with the invention is distinguished by the fact that it comprises:

a base plate which is intended to be fixed on the top face of the ski and carries an approximately vertical locking member provided with locking means directed towards the front tip of the ski;

a body mounted on the base plate for pivotal displacement about a transverse axis;

a jaw unit for retaining the toe end of the ski boot, said jaw unit being guided within a housing of the body with a possibility of rotational displacement and translational displacement in the forward direction;

two bearing elements rigidly fixed to the jaw unit, one element being directed towards the tip of the ski and the other element being directed towards the heel of the ski;

a piston capable of displacement within the body in a direction parallel to the longitudinal axis of the ski;

a resilient member housed within the body and so arranged as to exert on the piston a force which is directed towards the heel of the ski in order to ensure that the rear face of said piston is resiliently applied against said first bearing element and in order to ensure that the second bearing element is resiliently applied against the locking means.

Locking of the body on the ski is achieved in a simple manner by means of a ramp which is adapted to cooperate with a transverse rod or rotatable roller.

Moreover, the piston is capable of cooperating with the jaw unit by means of flat bearing faces or by means of a vertical roller which is adapted to engage in a V-shaped (dihedral) recess.

Other features of the invention will be more apparent to those skilled in the art upon consideration of the following description and accompanying drawings, wherein:

FIG. 10 is a fragmentary cross-sectional top view which is similar to FIG. 3 and shows a first alternative embodiment of the toe abutment member of FIGS. 1 to 9;

FIG. 11 is a view which is similar to FIG. 10 and shows a torsional release;

FIG. 12 is a front cross-sectional view which is similar to FIG. 2 and shows a second alternative embodiment of the toe abutment member of FIGS. 1 to 9; and FIG. 13 is a fragmentary view in the direction of the arrow A in FIG. 12.

Figure 1:
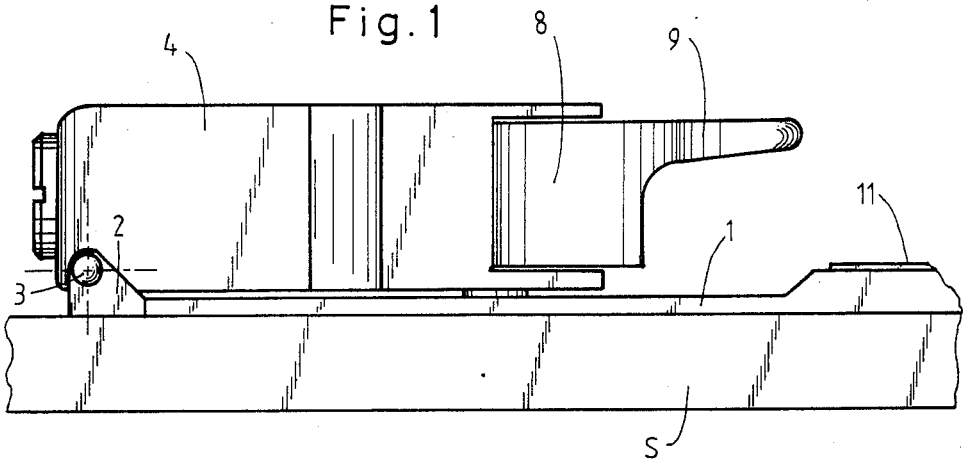
FIG. 1 is a side view of one example of construction of a toe abutment member in accordance with the invention.

The toe abutment member of FIGS. 1 to 9 comprises a base plate 1 fixed on the top face of the ski S by means of screws (not shown in the drawings). The tip of the ski is located at the left of the figures.

The base plate 1 is provided at the front end with a pair of side cheeks 2 adapted to extend vertically and to support a cross-pin 3 which is secured against translational displacement by riveting at both ends. The body 4 of the toe abutment member is pivotally mounted on the cross-pin 3 between the cheeks 2.

In its central zone, the plate 1 is adapted to carry an upstanding locking member 5 which may be secured to the plate 1 by any suitable means such as welding or riveting, or else it may form an integral part of said plate. Said member 5 is provided with a locking means consisting of a ramp 6 which is directed towards the front end of the ski and upwardly inclined in the forward direction. The lateral edges 5*a*, 5*b* of the member 5 have a cylindrical configuration. In the example which is illustrated, the ramp 6 is a flat surface. The line of intersection of said surface with the cylindrical edges of the member 5 is consequently an ellipse, the width "a" of which decreases from the bottom upwards.

The member 5 penetrates into the body 4 through an opening 7 formed in the underface of body 4. The opening 7 is so dimensioned as to ensure that the member 5 does not interfere with the pivotal displacement of the body 4 about the pivot-pin 3.

The toe abutment member comprises a jaw unit 8 for retaining the toe end of the ski boot (not shown in the drawings). The jaw unit comprises a pair of lateral arms 9 which are advantageously fitted with slip linings 10. The jaw unit 8 may be provided if necessary with means for adjusting the height and the width of the arms 9 in order to ensure that these latter exert a suitable gripping action on the front portion of the ski boot (either the upper or the sole). The adjustment means just mentioned are well-known, however, and have therefore been omitted from the drawings for the sake of enhanced simplicity. Moreover, the base plate 1 is provided with a slide plate 11 which is intended to support the underface of the front portion of the sole in accordance with a practice which is also well-known.

There is formed within the body 4 a housing 12 which has a horizontal bottom wall 12*a* and a horizontal top wall 12*b* and which opens towards the rear end of the ski.

That portion of the jaw unit 8 which is located in front of the arms 9 has a thickness equal to the height of the housing 12. Said front portion is placed within the housing 12 and is guided therein by the horizontal walls 12*a*, 12*b*. Provision is made in the front portion for an approximately rectangular central opening which surrounds the locking member 5. The opening 13 has a longitudinal dimension which is greater than that of the member 5 and a transverse dimension which is equal (with due allowance for operating clearance) to the diameter of the cylindrical portion of the member 5. There is placed in the front portion of the opening 13 a transverse rod 14 which is rigidly fixed to the jaw unit 8 by riveting at both ends.

The jaw unit 9 has a flat front face 15. A cylindrical bore 16 is formed in the front end of the body 4 and is parallel to the longitudinal axis of the ski. Said bore is closed at the front end by an externally threaded end cap 17 and communicates at the rear end with the housing 12. A piston 18 in the form of a cylindrical sleeve is slidably mounted within the bore 16. A helical compression spring 19 is applied at one end against the end-cap 17 and produces action on the piston in order to urge this latter towards the rear and to apply the face 20 of said piston against the front face of the jaw unit 8. Said jaw unit is in turn urged in a rearward direction and the transverse rod 14 is applied against the ramp 6 of the locking member 5.

Figure 2:
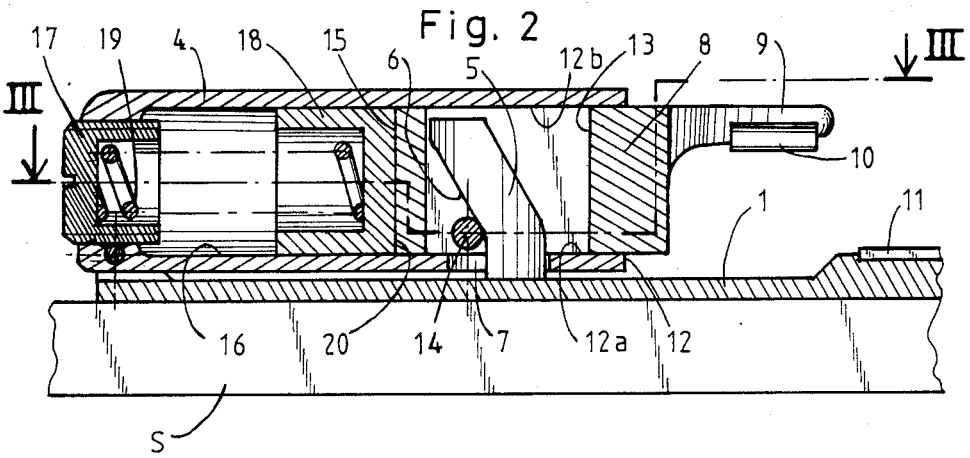
FIG. 2 is a side view of the same toe abutment member but taken in cross-section along the vertical plane II—II, of FIG. 3.
Figure 3:
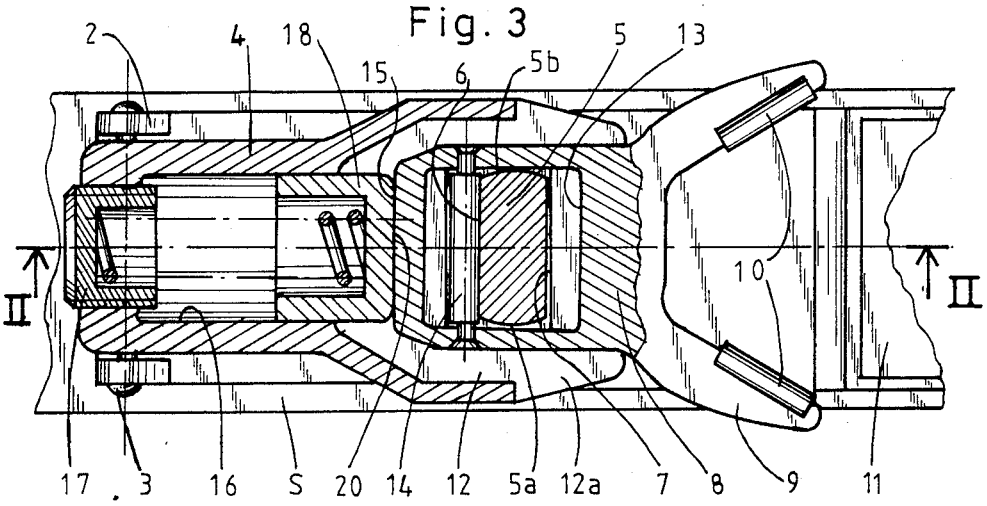
FIG. 3 is a top view taken in cross-section along the plane represented by the chain-dotted line III—III of FIG. 2.
Figure 4:
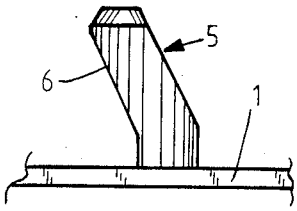
FIGS. 4 and 5 are detail views consisting respectively of a side view and front view of the locking member carried by the base plate.
Figure 5:
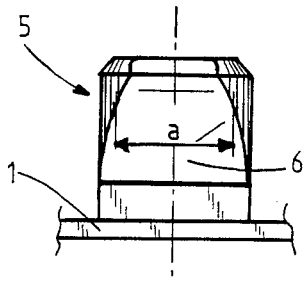

Said toe abutment member operates as follows:

Under normal conditions of skiing, the jaw unit occupies the position shown in FIGS. 2 and 3 and maintains the toe end of the ski boot centered on the ski.

Figure 6:
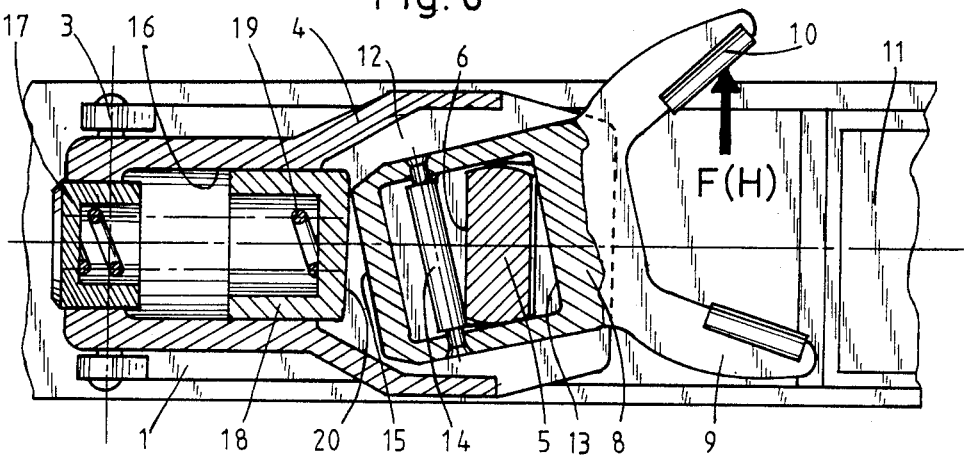
FIG. 6 is a view which is similar to FIG. 3 and shows a torsional release.
Figure 7:
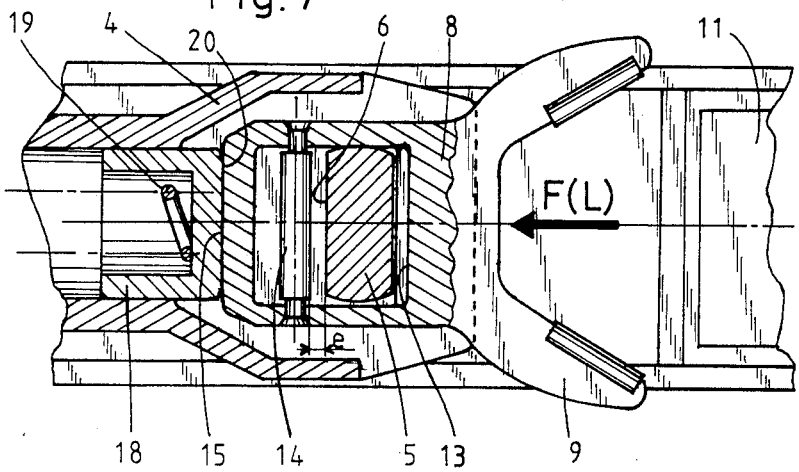
FIG. 7 is a fragmentary view which is similar to FIG. 3 and shows the toe abutment member subjected to a longitudinal thrust force.

When a torsional stress is exerted on the skier's leg, the ski boot applies against one of the arms 9 a transverse horizontal force F(H) which tends to produce a lateral pivotal displacement of the jaw unit 8. If the force F(H) is of sufficiently high value, the jaw unit in fact undergoes a pivotal movement within its housing 12 and in a horizontal plane. During this movement, and as illustrated in FIG. 6, the rod 14 is applied against one of the edges of the ramp 6 whilst one of the arrises of the face 15 thrusts the piston 18 into the interior of its bore 16 while compressing the spring 19.

If the force F(H) is sufficiently large and of sufficiently long duration to constitute a potential danger of injury to the skier's leg, the jaw unit 8 undergoes a pivotal displacement through an angle such as to allow the toe end of the ski boot to escape to one side. Should this not be the case, the piston 18 restores the jaw unit to its normal position of FIG. 3, thus recentering the ski boot on the ski.

While skiing is in progress, it frequently happens that the jaw unit of the toe abutment member is subjected to forwardly-directed longitudinal thrust forces by the toe end of the ski boot. These thrust forces appear in particular in the event of loss of balance resulting in a forward-fall movement of the skier (thus urging the heel-holding member to its open position), in the event of sharp flexural deformation of the ski (during which the ski boot is compressed between the heel-holding member and the toe abutment member), or in the event of abrupt deceleration of the ski (for example as a result of arrival of the ski in fresh unpacked snow).

The longitudinal thrust generates parasitic friction forces which arise on the one hand between the toe end of the ski boot and the arms of the toe abutment member and on the other hand between the underface of the sole and the slide plate.

In the toe abutment member in accordance with the invention, a longitudinal thrust F(L) of relatively high value produces a forward displacement of the jaw unit 8. During this movement, the front face 15 of said toe abutment member thrusts back the piston 18 within its bore, thus compressing the spring 19 whilst the rod 14 is moved away from the ramp 6 by a distance "e" (proportional to F(L) ). It is apparent that, starting from the position of FIG. 7 which illustrates this situation, the jaw unit 8 is free to undergo a lateral pivotal displacement from one side of the ski to the other until the rod 14 encounters one edge of the ramp 6 (in the position shown in FIG. 6). By virtue of this freedom of pivotal motion, the parasitic friction forces mentioned earlier are virtually compensated and the toe abutment member has practically constant stiffness of torsional release.

Figure 8:
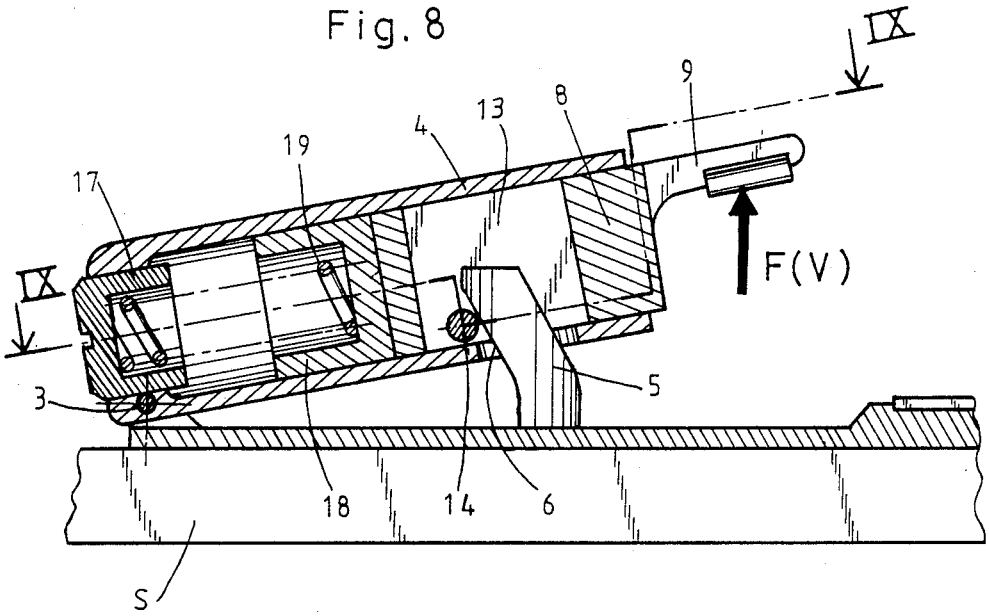
FIG. 8 is a view which is similar to FIG. 2 and shows a backward-fall release.
Figure 9:
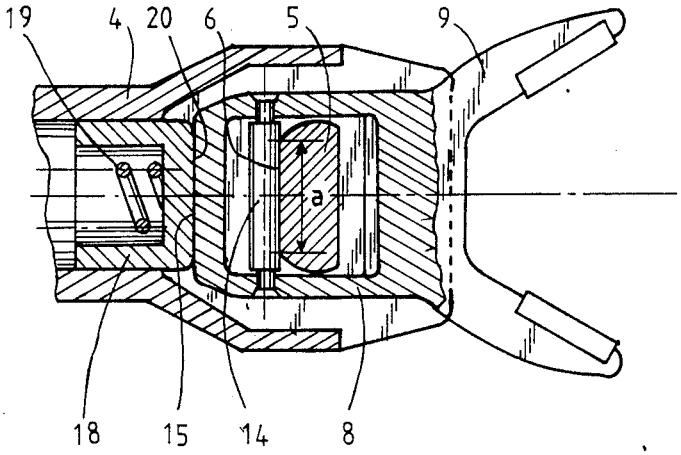
FIG. 9 is a fragmentary top view taken in cross-section along the plane IX—IX of FIG. 8.

FIGS. 8 and 9 illustrate the situation in which the skier has experienced a backward fall. In this situation, the edge of the sole of the front portion of the ski boot exerts beneath the arms 9 an upwardly directed vertical force F(V). If this force is sufficiently large, the body 4 is lifted and pivots about the cross-pin 3. During this lifting movement, the rod 14 travels along the ramp 6 and produces a displacement of the jaw unit 8 in sliding motion within the body 4 towards the tip of the ski while compressing the spring 19. The jaw unit therefore performs a double movement of pivotal displacement in the upward direction and of translational displacement in the forward direction, thus permitting a particularly smooth and reliable release of the toe end of the ski boot. Provision could be made for a stop, the function of which would be to limit the lifting movement of the body in order to prevent the rod 14 from moving away from the locking member 5 at the end of travel.

By reason of the fact that the width "a" of the ramp 6 decreases from the bottom upwards, the line of contact between the rod 14 and said ramp is shorter when the jaw unit is in the raised position (FIG. 9) than when it is in the normal position (FIG. 3). In consequence, the retaining torque applied to the jaw unit is smaller when this latter is lifted than when it is in the normal position. Thus in the case of a combined backward and twisting fall, practically constant stiffness of torsional release is also obtained whereas the parasitic friction forces localized between the sole and the underside of the arms of the jaw unit are compensated by the reduction in leverage effect "a". This result is also achieved in all the other cases in which the sole is gripped too tightly by the arms of the jaw unit, especially in the event of an error in height adjustment of said unit or when a layer of snow is present beneath the sole.

A point worthy of note is that, even in the event of upward displacement of the jaw unit for one of the reasons stated in the foregoing, said jaw unit is maintained on the ski and centered with a high degree of accuracy. Furthermore, the cooperation on the one hand between the piston 18 and the flat face 15 and on the other hand between the rod 14 and the ramp 6 are maintained. In consequence, there does not appear any vacillation or unsteadiness of the front tip of the ski boot in the toe abutment member which is essential for good control of the skis.

In the first alternative embodiment of FIGS. 10 and 11, the piston 18 has a recessed rear face 21 having the shape of a dihedron with vertical faces and a rounded bottom portion whilst the jaw unit 8 is provided on its front face with a freely rotatable vertical roller 22. The spring 19 acts upon the piston 18 in such a manner as to apply the bottom portion of the dihedral recess 21 against the roller 22 and also to apply the rod 14 against the ramp 6 as in the preceding embodiment.

In the event of appearance of a high transverse force F(H), the jaw unit 8 swings to one side as shown in FIG. 11. During this movement, the rod 14 bears against one of the edges of the ramp 6 whilst the roller 22, which tends to move out of the dihedral recess 21, thrusts back the piston 18 and compresses the spring 19.

Under a longitudinal thrust F(L) and under a vertical force F(V), the performance characteristics of this alternative embodiment are identical with those of the preceding embodiment.

In the second alternative embodiment of FIG. 12, the locking member 23 is designed in the form of a vertical yoke which is adapted to carry a freely rotatable transverse roller 24; this latter is applied against an inclined ramp 25 which is either formed on or added to the jaw unit 8. In the event of a backward fall (not illustrated), the roller 24 applies force against the ramp 25 in order to displace the jaw unit 8 in the forward direction and to compress the spring 19. The width of the ramp 25 preferably decreases from the top downwards, as seen in FIG. 13, which is a view in the direction of arrow A in FIG. 12, with the result that, as in the embodiment of FIGS. 1 to 9, the inherent stiffness of torsional release decreases progressively as the jaw unit is lifted. In the event of torsion combined with longitudinal thrust, this alternative embodiment operates in the same manner as the embodiment of FIGS. 1 to 9.

The embodiments and forms of construction described in the foregoing have been given solely by way of example. A number of different modifications may accordingly be contemplated without thereby departing from the scope of the invention. Thus it follows that the transverse rod 14 could be replaced by a rotatable roller in order to reduce the internal friction forces in the toe abutment member. Furthermore, the ramp which controls the backward-fall release is not necessarily flat; provision could be made for a curved ruled surface.

In the alternative embodiment of FIGS. 10, 11, it would be possible to mount the roller 22 on the piston 18 and to provide the dihedral recess 21 in the front face of the jaw unit 9.

The different leverage effects which govern torsional and backward-fall trips are so determined that the torsional release force F(H) is approximately five or six times smaller than the backward-fall release F(V); tests carried out on an actual ski run have in fact shown that this ratio of stiffnesses permits skiing with complete safety and without any accidental trips. It clearly remains possible to modify the degrees of stiffness of release as a function of the skier's morphology by operating the adjustment end-cap 17.

Instead of providing ramps 6, 25 having a width which varies progressively in the vertical direction, it would not constitute any departure from the scope of the invention to provide ramps consisting simply of two tiered sections of different width. Thus the function of one section of substantial width would be to establish the degree of stiffness of release under torsional stress alone. The function of the other section having the smallest possible width would be to establish the degree of stiffness of release under torsional stress when the jaw unit has undergone an upward displacement, irrespective of the extent of said displacement.

Although the safety ski binding described in the foregoing has been designed to retain the toe end of the ski boot, it would be feasible to employ said ski binding as a heel-retaining unit with forward-fall and torsional release. To this end, it would only be necessary to replace the jaw unit by a heel-gripping member of suitable shape.

What is claimed is:

1. A safety toe abutment member for a ski, wherein said member comprises:

a base plate which is intended to be fixed on the top face of the ski and is adapted to carry an upstanding locking member provided with locking means directed towards the front tip of the ski;

a body mounted on the base plate for pivotal displacement about a transverse axis;

a jaw unit for retaining the toe end of the ski boot, said jaw unit being guided within a housing of the body for rotational displacement and translational displacement in the forward direction;

two bearing elements rigidly fixed to the jaw unit, one element being directed towards the tip of the ski and the other element being directed towards the heel of the ski;

a piston capable of displacement within the body in a direction parallel to the longitudinal axis of the ski;

a resilient member housed within the body and so arranged as to exert on the piston a force which is directed towards the heel of the ski in order to ensure that the rear face of said piston is resiliently applied against said first bearing element and in order to ensure that the second bearing element is resiliently applied against the locking means.

2. A toe abutment member according to claim 1, wherein the jaw unit has a central opening which surrounds the locking member and has an approximately rectangular shape which permits translational displacement of the jaw unit in the forward direction and lateral pivotal displacement of said unit with respect to said locking member.

3. A toe abutment member according to claim 1, wherein the locking means is a ramp which is adapted to cooperate with a bearing element in the form of a transverse rod or roller.

4. A toe abutment member according to claim 3, wherein the ramp has a width "a" which decreases from the bottom upwards.

5. A toe abutment member according to claim 4, wherein the ramp is flat.

6. A toe abutment member according to claim 1, wherein the locking means is a transverse roller which is adapted to cooperate with a bearing element in the form of a ramp.

7. A toe abutment member according to claim 6, wherein the ramp has a width which decreases from the top downwards.

8. A toe abutment member according to claim 7, wherein the ramp is flat.

9. A toe abutment member according to claim 1, wherein the first bearing element is constituted by the flat front face of the jaw unit, said front face being adapted to cooperate with the rear face of the piston, said rear face being also flat.

10. A toe abutment member according to claim 1, wherein the first bearing element is a freely rotatable roller having a vertical axis and adapted to cooperate with the rear face of dihedral shape of the piston.

* * * * *